US005437433A

United States Patent [19]

Rezek

[11] Patent Number: 5,437,433

[45] Date of Patent: Aug. 1, 1995

[54] ADJUSTABLE STAIR RAIL SYSTEM

[75] Inventor: Ron Rezek, Culver City, Calif.

[73] Assignee: Lavi Industries, Inc., Valencia, Calif.

[21] Appl. No.: 127,875

[22] Filed: Sep. 28, 1993

[51] Int. Cl.[6] ..... E04F 11/18

[52] U.S. Cl. ..... 256/67; 256/59

[58] Field of Search ..... 256/67, 65, 59

[56] References Cited

U.S. PATENT DOCUMENTS

| | | | |
|---|---|---|---|
| 1,110,183 | 9/1914 | Barham | 256/65 X |
| 1,316,155 | 9/1919 | Harrison et al. | 256/65 |
| 2,754,092 | 7/1956 | Cremens | 256/65 X |
| 3,351,324 | 11/1967 | Blum et al. . | |
| 4,125,249 | 11/1978 | Zen . | |
| 4,150,907 | 4/1979 | Thurnauer . | |
| 4,496,262 | 1/1985 | Sangster . | |
| 4,767,232 | 8/1988 | Francis . | |
| 4,886,245 | 12/1989 | Manzo . | |
| 4,928,930 | 5/1990 | Chung . | |
| 5,143,472 | 9/1992 | Reed et al. | 256/59 X |
| 5,149,060 | 9/1992 | Boes . | |

FOREIGN PATENT DOCUMENTS

| | | | |
|---|---|---|---|
| 0734196 | 5/1966 | Canada . | |
| 0837863 | 3/1970 | Canada . | |
| 584560 | 2/1925 | France | 256/67 |
| 3320454 | 12/1984 | Germany . | |
| 3619993 | 12/1987 | Germany | 256/59 |
| 3920260 | 1/1991 | Germany . | |
| 1008216 | 10/1965 | United Kingdom . | |

*Primary Examiner*—Anthony Knight

*Attorney, Agent, or Firm*—Rothwell, Figg, Ernst & Kurz

[57] ABSTRACT

An adjustable stair rail system suitable for use by a homeowner in which various adjustments in positioning the rail can easily be made on site. The system includes a plurality of balusters and adjustable baluster connectors. The height of the balusters can be adjusted, which balusters engage the outer surface of the rail so as to enable angular movement of the rail with respect to the balusters in an adjustable fashion. The invention further includes an adjustable tee connection to secure the rail to one or more vertical support posts.

9 Claims, 12 Drawing Sheets

ADJUSTABLE STAIR RAIL SYSTEM

BACKGROUND OF THE INVENTION

1. Field of the Invention

The present invention relates generally to handrail assemblies for staircases, ramps or the like. More specifically, the present invention relates to "do-it-yourself" handrail assemblies in which the height and angle of incline of the rail can easily be adjusted by an unskilled person.

2. Description of the Relevant Art

It is known in the art to position rails, e.g. handrails or cap rails, so as to be inclined or slanted at an angle corresponding to that of a staircase, ramp, or the like. It is also known to utilize supports which accommodate variations in the angle of incline of the rail. See, for example, U.S. Pat. Nos. 4,767,232 (1988), 4,886,245 (1989), and 4,928,930 (1990), and German Patent 3,920,260 (1991). The last-mentioned patent also discloses vertical supports for a rail which supports are capable of being adjusted to different heights.

It is further known in the art to secure the terminal end of a handrail to a vertical stanchion with the angle of connection being adjustable. See U.S. Pat. No. 4,150,907 (1979). This patent discloses a semi-spherical member that is fixed to the stanchion, and a cylindrical collar member having a split shank portion which is inserted into the terminal end of the rail. The collar has several other components including an internal clamp plate welded thereto with a slot for receiving a screw. The semi-spherical member is rotatably seated on a bevelled edge formed on the collar.

As disclosed in the U.S. Pat. No. 4,150,907 patent, the surface of the semi-spherical member is spaced from the clamp plate, and the slot in the clamp plate does not extend over the full length thereof. In addition, the clamp plate itself does not extend fully across the diameter of the collar. As such, the degree of adjustment is limited by the amount that the semi-spherical member can be rotated against the edge of the collar while the aperture in the former is still aligned with the slot in the latter.

Moreover, the assembly disclosed in the U.S. Pat. No. 4,150,907 patent includes several components that must be secured together, namely, the clamp plate which is welded to the collar. In addition, the collar has a specially formed bevelled edge configured to receive the outer surface of the semi-spherical member. Such structure results in a somewhat cumbersome arrangement that in turn results in increased manufacturing costs.

Further, the prior art adjustable rail systems are not ideally suited for use by relatively unskilled persons in homes or other environments in which the aesthetic appearance of the rail system is of prime importance. For example, the assembly shown in the U.S. Pat. No. 4,150,907 patent is intended for use on handicap ramps. Such systems are not well suited to easy "do-it-yourself" installation by a homeowner, nor do they have an appearance desirable for use in a home.

Accordingly, there is a need in the art for an aesthetically pleasing adjustable stair rail apparatus, suitable for use in a home, which can be easily assembled by an unskilled person, and which can be manufactured for less cost and with less trouble than the prior art systems.

SUMMARY OF THE INVENTION

The present invention provides an adjustable stair rail assembly for use by a homeowner or other person not skilled in carpentry or the like. The assembly includes a plurality of balusters and vertical support posts that engage the outer surface of a rail in an angularly adjustable fashion. The height of the balusters is also adjustable.

Adjustability of both the height of the balusters and the angle at which they meet the hand rail permits on-site adjustments by relatively unskilled persons. Such adjustments are often necessary because the steps in a staircase typically vary in size or relative positioning by some degree, and because, in the prior art systems, measurements made prior to assembling the stair rail often prove to be inaccurate. Even seemingly small inaccuracies in such measurements can require on-site cutting, drilling, etc., of the apparatus to achieve a proper stair rail.

The present invention permits various adjustments in both the height and angle of the rail to be made with little trouble by even an unskilled person.

In one embodiment, the present invention includes a plurality of vertical support posts, each of which receives an adjustable tee which tee includes a socket member in the form of a hollow cylindrical sleeve, the sleeve being open at one end and closed at the other end. The closed end is in the form of an arcuate recess or depression having an aperture disposed centrally therein. The recess is shaped to mate with a saddle member which is secured to the rail. Together, the socket and saddle members comprise the adjustable tee.

The saddle member is hollow and has one end which is substantially spherically-shaped so as to be adjustably receivable within the arcuate recess in the socket member. The saddle is positioned in the recess so as to rest against the surface thereof. The spherically shaped portion has an elongated slot running along a substantial portion of its length which aligns with the aperture in the socket member to provide a large degree of adjustability between the two members.

At the other end, the saddle has opposite rounded portions which give the member its saddle shape and extend partly around the rail when the same is secured to the saddle. This end of the saddle also includes a pair of extensions which are disposed opposite to each other and between the aforementioned rounded portions. These extensions have an aperture to receive fastening means for securing the saddle to the rail.

The socket member and the saddle are preferably of one-piece construction which makes manufacturing and assembly of the apparatus easy.

In another aspect of the present invention, the open end of the hollow socket member is inserted into the terminal end of the rail so as to form an extension thereof. The other end of the socket member, i.e., the end with an arcuate recess, receives the spherically-shaped end of the saddle, which saddle is secured at its opposite end to a vertical support post.

The present invention further provides adjustable balusters for connecting the rail to the stair treads (i.e., the horizontal section of a step). The lower end of the balusters has a blind bore cut therein which bore receives a dowel member that also is received in a bore formed in the stair tread. The lower length of the bore in the baluster is such that the lower end thereof can be cut to size for each application.

The present invention also provides an adjustable baluster connector which includes a spindle top member that cooperates with the baluster to permit fine adjustment to the height thereof. The balusters are formed with an annular bore in an upper portion thereof. The bore is configured to receive a spindle top member in the form of a hollow cylindrical sleeve having an open lower end and a substantially closed, rounded upper end. The open lower end slides into the annular bore of the post and can be selectively positioned at a desired depth therein to make fine adjustments to the height of the baluster. The closed rounded upper end has an aperture which receives means for fastening the spindle top to the post at the desired depth, which means passes through the spindle top aperture and into a central bore disposed within the annular bore in the upper portion of the post.

The adjustable baluster connector utilizes a different saddle member than that discussed above, such saddle member having opposite surfaces one of which is saddle shaped in a manner similar to that of the previous embodiment so as to receive the exterior surface of a rail. However, the opposite surface of the saddle member includes an arcuate depression configured to receive the rounded upper end of the spindle top. This arcuate depression has a slot disposed therein which slot aligns with the aperture in the upper end of the spindle top to permit relative adjustment of the two members.

The adjustable baluster connectors which preferably is made of brass (or other suitable materials), provide a stair rail support which has a very aesthetically pleasing appearance, yet which can be easily assembled by an unskilled person to permit adjustment of both the vertical height of the post and the angular connection between the rail and the post.

BRIEF DESCRIPTION OF THE DRAWINGS

Other features and advantages of the present invention will be apparent from the following detailed description of preferred embodiments thereof when read in conjunction with reference to the accompanying drawings, wherein.

DETAILED DESCRIPTION OF THE PREFERRED EMBODIMENTS

Figure 1:
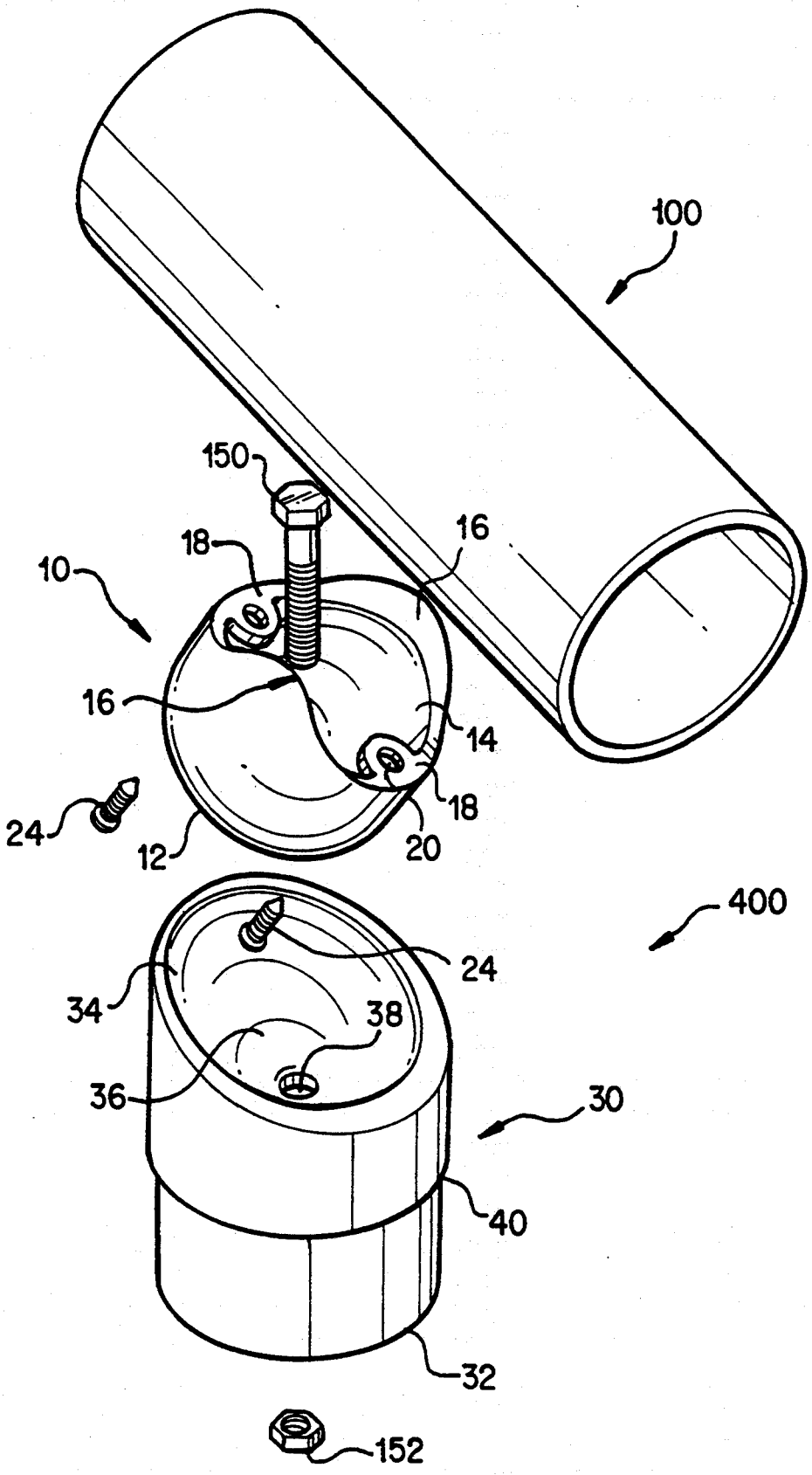
FIG. 1 is an exploded view of an adjustable stair rail assembly including an adjustable tee according to a first embodiment of the present invention.

With reference to FIG. 1, an adjustable stair rail system according to a first embodiment of the present invention is shown to include an adjustable tee indicated generally at 400. The adjustable tee includes a saddle member indicated by the reference numeral 10, and a socket member indicated by the reference numeral 30. FIG. 1 is an exploded view depicting the elements as they would be assembled. The saddle member 10 is preferably a one-piece hollow member fabricated by any suitable process from an aesthetically pleasing material that is suitable for installation in a home, e.g., brass casting.

The saddle 10 has a substantially spherically shaped end 12 and an opposite end 14 open to the interior of the saddle. The end 14 includes a pair of rounded extended portions 16 which give this end of the member 10 a saddle shape for receiving a tubular hand rail, as will be described below.

The saddle-shaped end 14 also includes a pair of inwardly directed extensions 18 with apertures 20 therein, which apertures are configured to receive means for securing the saddle to the handrail 100. The rail 100 receives any suitable fastening means that pass through apertures 20 in extensions 18. Such fastening means is preferably in the form of self-tapping screws 24 which can be positioned in the rail by a conventional power drill. When the saddle 10 is secured to the tubular handrail 100, the rounded portions 16 extend partly around the exterior surface of the handrail to support the same.

Figure 2C:
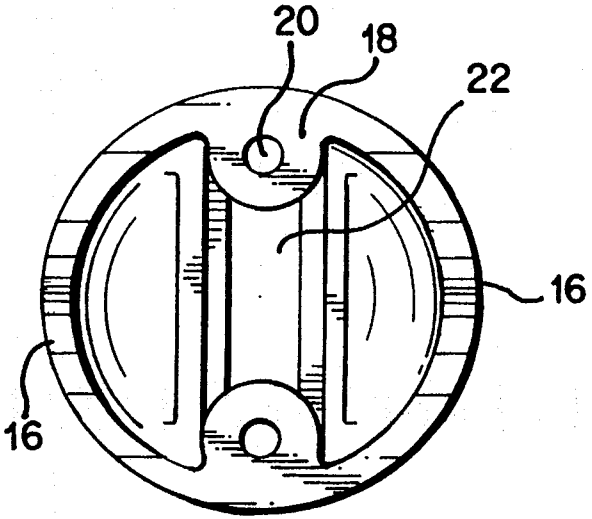
FIGS. 2A–2C are, respectively, a bottom plan view, a side sectional view, and a top plan view of a saddle member according to the embodiment of FIG. 1.
Figure 2B:
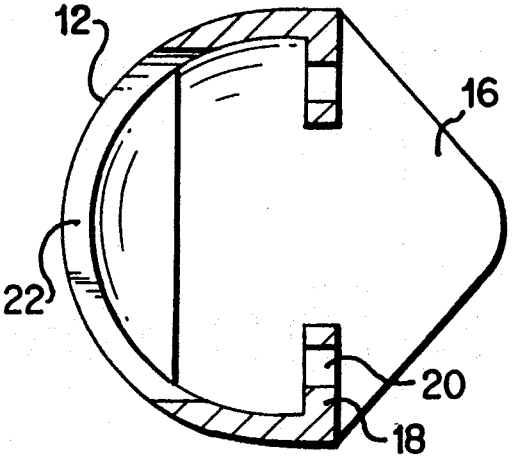
Figure 2A:
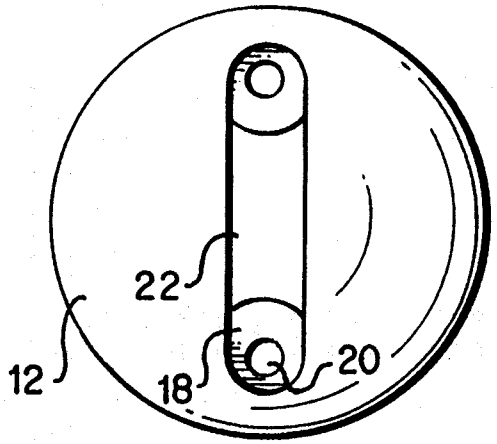

As best seen in FIGS. 2A–2C, the spherically-shaped portion 12 of saddle 10 includes an elongated slot 22 running along a major length of the portion 12. The slot is preferably centrally located with respect to the saddle member 10 as seen in FIGS. 2A and 2C.

Figure 3C:
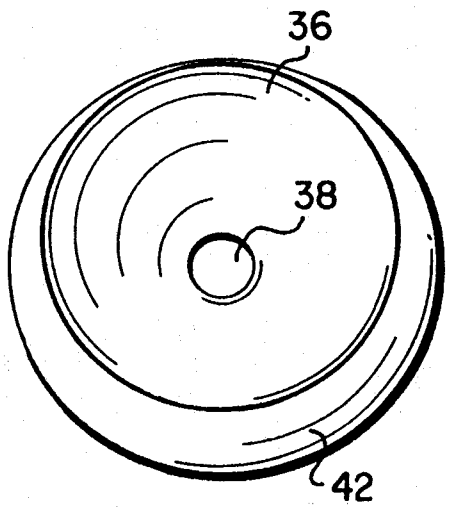
FIGS. 3A–3C are, respectively, a bottom plan view, a side sectional view, and a top plan view of a socket member according to the embodiment of FIG. 1.
Figure 3B:
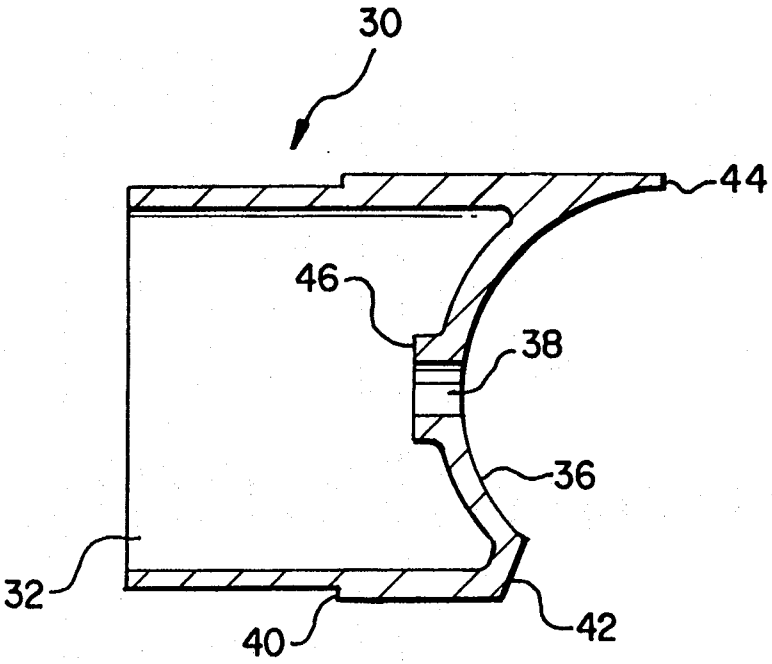
Figure 3A:
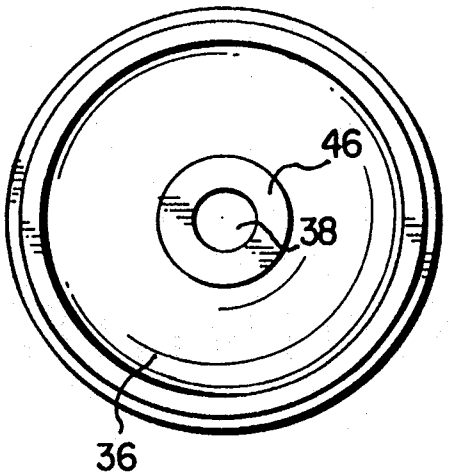

A socket member 30 cooperates with the saddle member 10 and is preferably in the form of a one-piece hollow tubular sleeve fabricated of a material similar to the saddle 10, such as brass casting. The socket 30 includes an open end 32 and a closed end 34. Closed end 34 includes an arcuate recess 36 which is a continuous closed surface except for a centrally disposed aperture 38. Arcuate surface 36 is shaped so as to receive the spherically-shaped end 12 of saddle member 10 in face-to-face contact. See FIGS. 3A–3C and 4A. The closed end 34 has a narrow edge 44 and a broader edge 42 as best seen in FIG. 3B. Edge 42 is preferably chamfered away from the arcuate recess to allow a wider degree of adjustment.

Figure 4A:
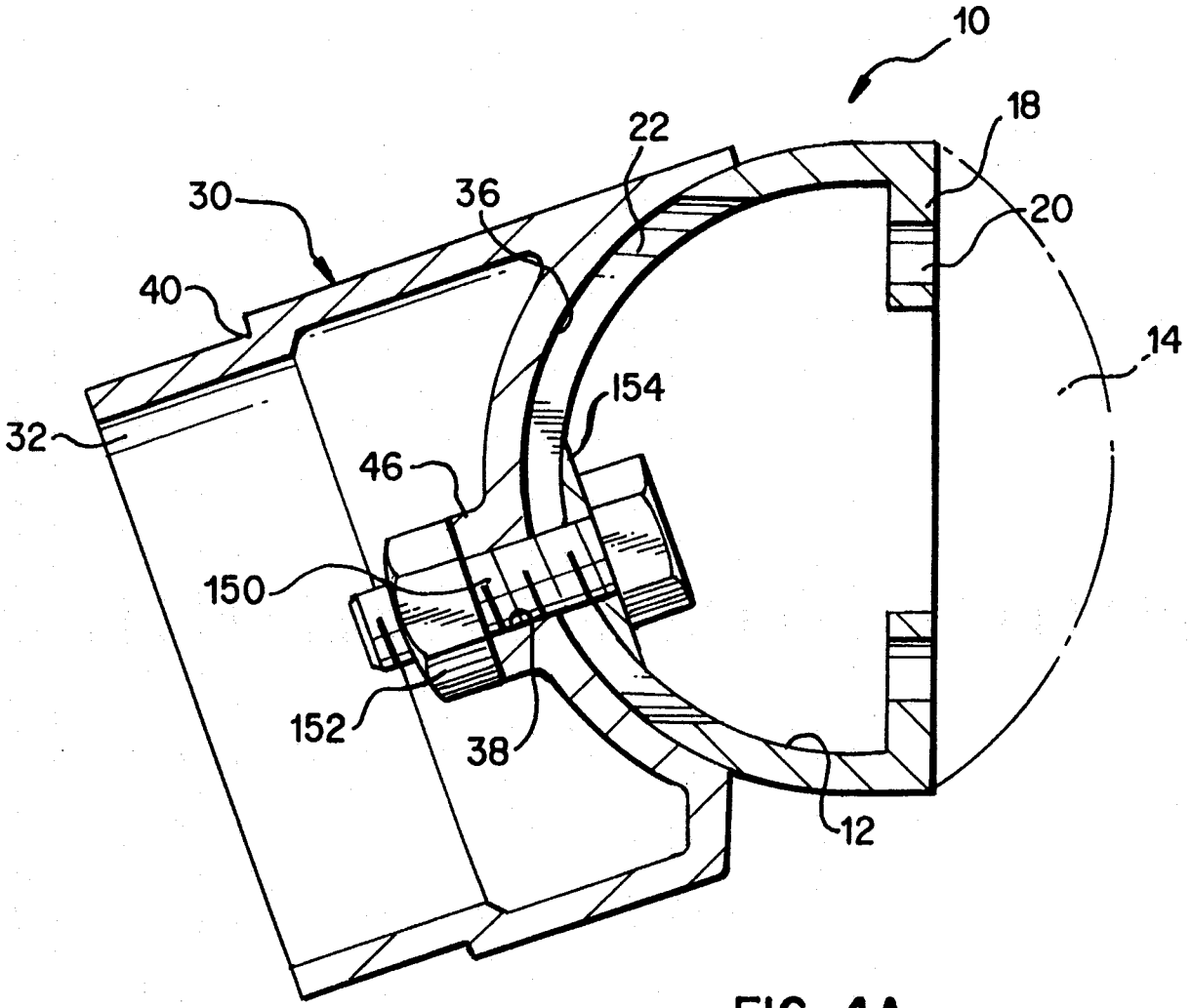
FIG. 4A is an elevational view in section of the saddle and socket members of FIGS. 2 and 3 secured together.

With attention directed now to FIG. 4A, the adjustable tee 400 is shown assembled with the saddle member 10 secured to the socket member 30 by a suitable fastening means, e.g., bolt 150 and nut 152. The angular position of the saddle member 10 (and thus the rail 100 to which it is affixed) with respect to the vertical support post (to which the socket member is affixed) can be varied over a wide range by rotating the saddle 10 within the arcuate recess 36 of the socket 30. The saddle is rotated to a desired position with the elongated slot 22 being moved relative to the aperture 38 in socket 30. However, during such movement, the slot 22 remains aligned with the aperture 38, i.e., the relative position of the slot 22 and aperture 38 is such that fastening means such as bolt 150 can be passed through each.

Figure 4C:
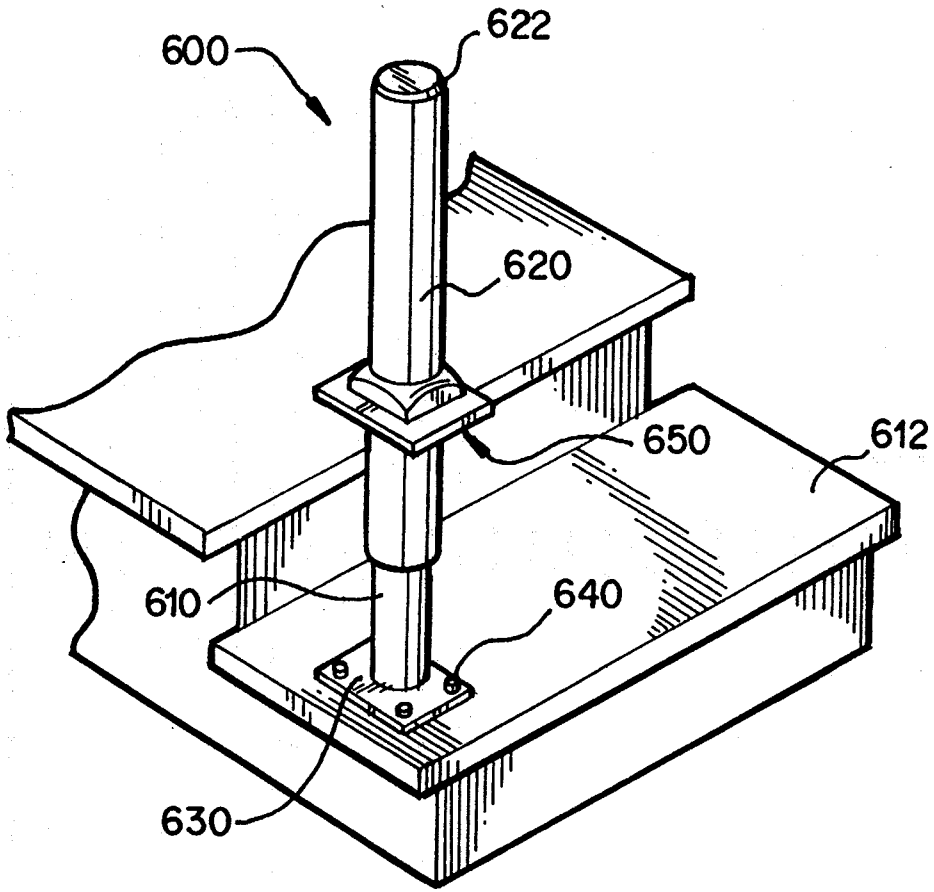
FIG. 4C is a perspective view of a vertical support post secured to a stair tread.
Figure 4B:
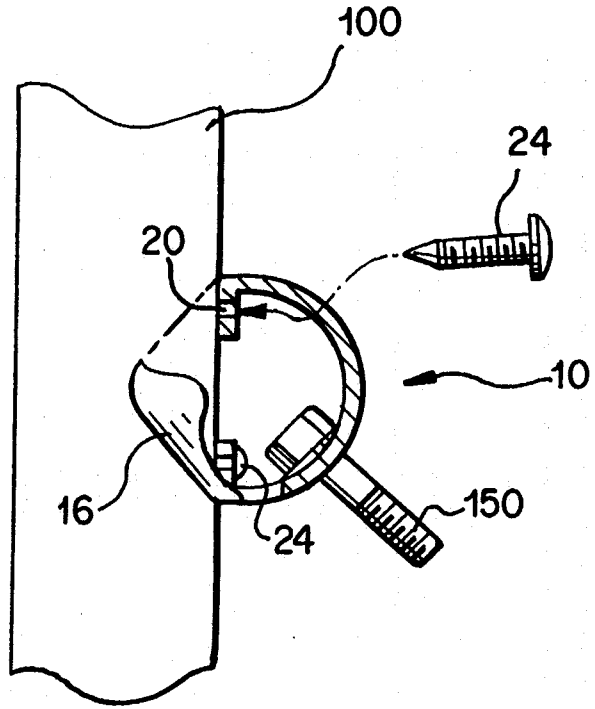
FIG. 4B is a part sectional view showing the adjustable tee attached to a rail.

The bolt 150, which has a head that is wider than the width of the slot 22 or, alternatively, can be used with a washer 154, is preferably preassembled with the adjustable tee 400. That is, the saddle 10 and socket 30 are secured together. To attach the saddle 10 to the rail 100, the tee 400 is disassembled and the self-tapping screws 24 are placed through apertures 20 in saddle 10 and driven into the rail. With the saddle secured to the rail 100, the bolt 150 is then placed into the socket to secure same to the saddle. It will be recognized that bolt 150 is in place when saddle 10 is secured to the rail as once the saddle is secured, access to place the bolt therein is not provided. The bolt 150 has means to enable the nut 152 to be threaded thereon (when assembling the adjustable tee 400) without the bolt turning. See FIG. 4B. In addition, it will be recognized by those skilled in the art that the adjustable tee 400 can be provided in unassembled form and the rail can be secured to the saddle before the latter is affixed to the socket 30.

The socket 30, between open end 32 and closed end 34, has a shoulder 40 formed thereon for abutting against the top edge of a vertical support post in which the open end 32 of socket 30 is inserted. An example of a vertical support post is indicated at 600 in FIG. 4C and includes a base plate post 610 and a vertical support post 620. The vertical post 620 has an upper edge 622 which abuts shoulder 40 of socket member 30. The post 620 telescopes over the base post 610, which base post 610 is secured to a stair tread 612 or landing via flange base plate 630 which is provided with suitable fastening means, e.g., bolts 640, for that purpose. Flange cover 650 is then slid over post 620 so as to overlie flange base plate 630. The cover 650 preferably engages the plate 630 in a snap-fit and is secured in position by any suitable means, e.g. a set screw (not shown) passing through the cover 650 and abutting vertical post 620. The open end 32 of the socket can also be positioned in the open end of the hand rail 100, with the saddle member 10 engaging the exterior side surface of a vertical support post, i.e., in a butt joint, as seen at arrow C in FIG. 11.

As will be appreciated, the slot 22 in saddle 10 preferably extends over substantially the entire width of the saddle. This feature, in combination with the direct contact of the saddle portion 12 with the socket recess surface 36, provides a wide range of adjustability. In addition, the socket 30 is provided on the underside of arcuate recess 36 with a boss 46 surrounding aperture 38 to provide structural support.

Figure 5C:
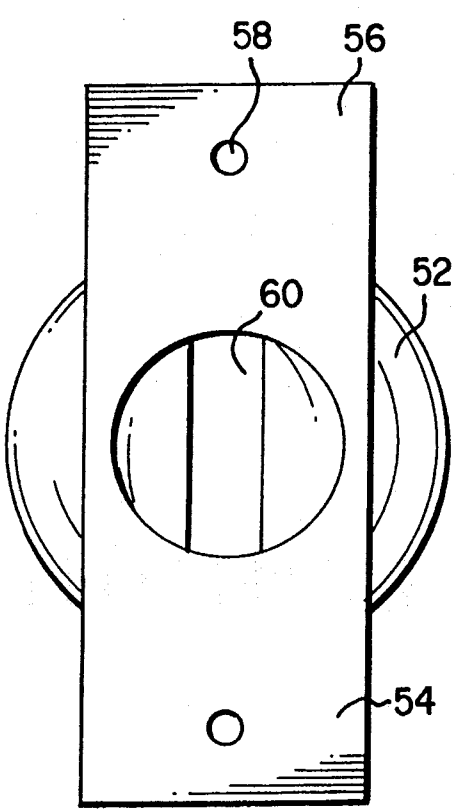
FIGS. 5A–5C are, respectively, a top plan view, a side sectional view, and a bottom plan view of a support member according to a second embodiment of the present invention.
Figure 5B:
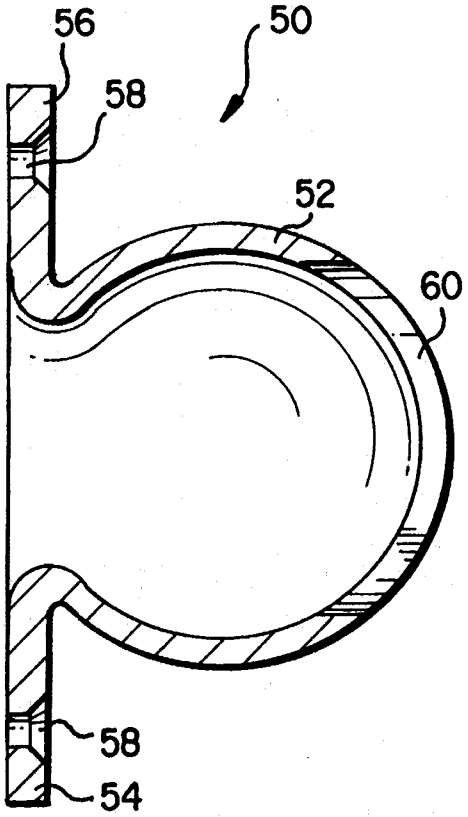
Figure 5A:
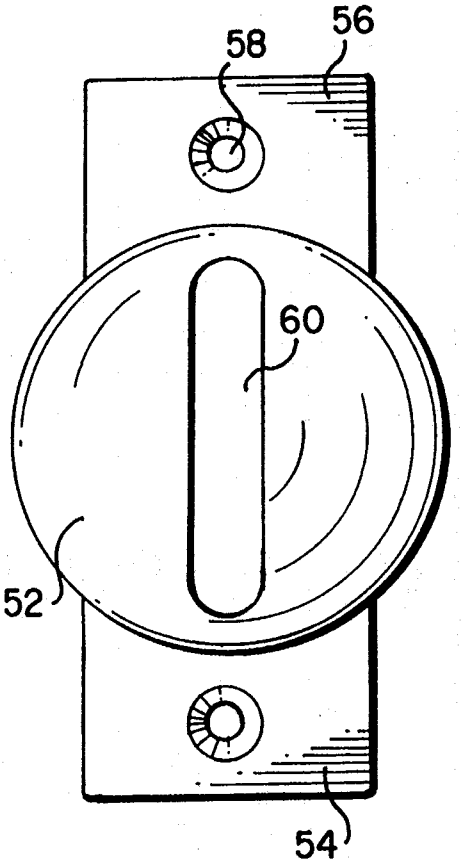

FIGS. 5A through 5C show another embodiment of an adjustable stair component in the form of an adjustable support member 50. Adjustable support 50 has one end defined by upper and lower plate portions 54, 56 and the other end defined by a spherical projection 52. The spherical projection 50 includes an elongated slot 60 at a distal portion thereof. The plate portions 54, 56 have apertures 58 for receiving means for securing the member 50 to a support surface (not shown).

The support member 50 can be utilized to adjustably secure the terminal end of a rail to a support surface, e.g., a newel post or a wall. The member 50 is attached to the flat surface with the plate portions 54, 56 against the surface and with suitable fastening means, e.g., screws, bolts, etc., passing through apertures 58.

The socket member 30 of the previous embodiment can be utilized with the support member 50. The socket 30 can be positioned in the terminal end of a hand rail and the arcuate recess 36 of the socket receives spherical projection 52 of support member 50. The adjustability of the members is achieved by relative rotation of the socket 30 and projection 52 of member 50, substantially as described above. However, those skilled in the art will appreciate that the support member 50 can be used in various situations to achieve adjustability of the socket with respect to a support member.

Figure 5D:
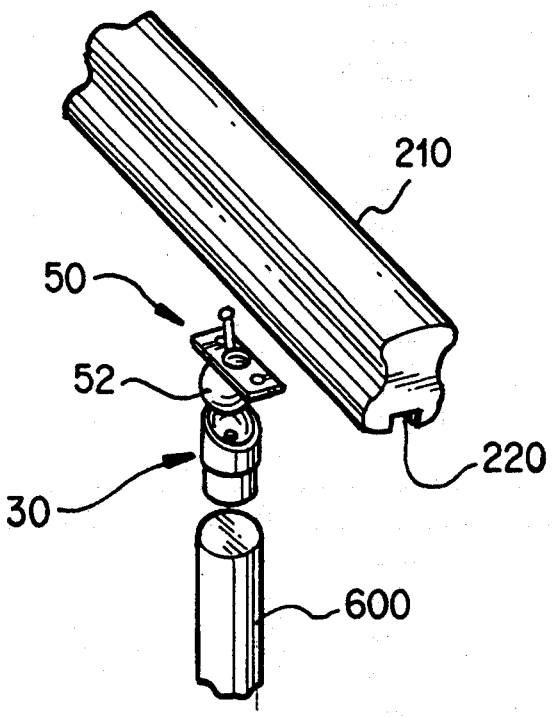
FIG. 5D is a perspective view of the support member of FIGS. 5A–5C attached to a cap rail.

Another aspect of adjustable support 50 is that it can be used to secure the aforementioned socket member to a wood cap rail 210 as shown in FIG. 5D. The wood cap rail 210 has a flat bottom or, preferably, a flat bottom with a rabbit or groove 220 formed therein, in which the flat plate portions 54, 56 can be inserted and suitably fastened. The spherical projection 52 faces downwardly in the FIG. 5D and is received within the socket member 30 as described above. The socket member is then attached to a vertical support post 600 as also is discussed above.

Figure 7B:
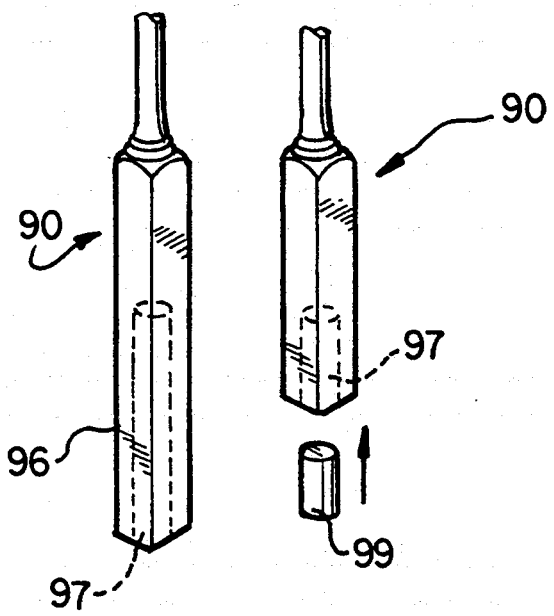
FIG. 7B is a perspective view of the adjustable baluster shown in FIG. 7A.
Figure 6:
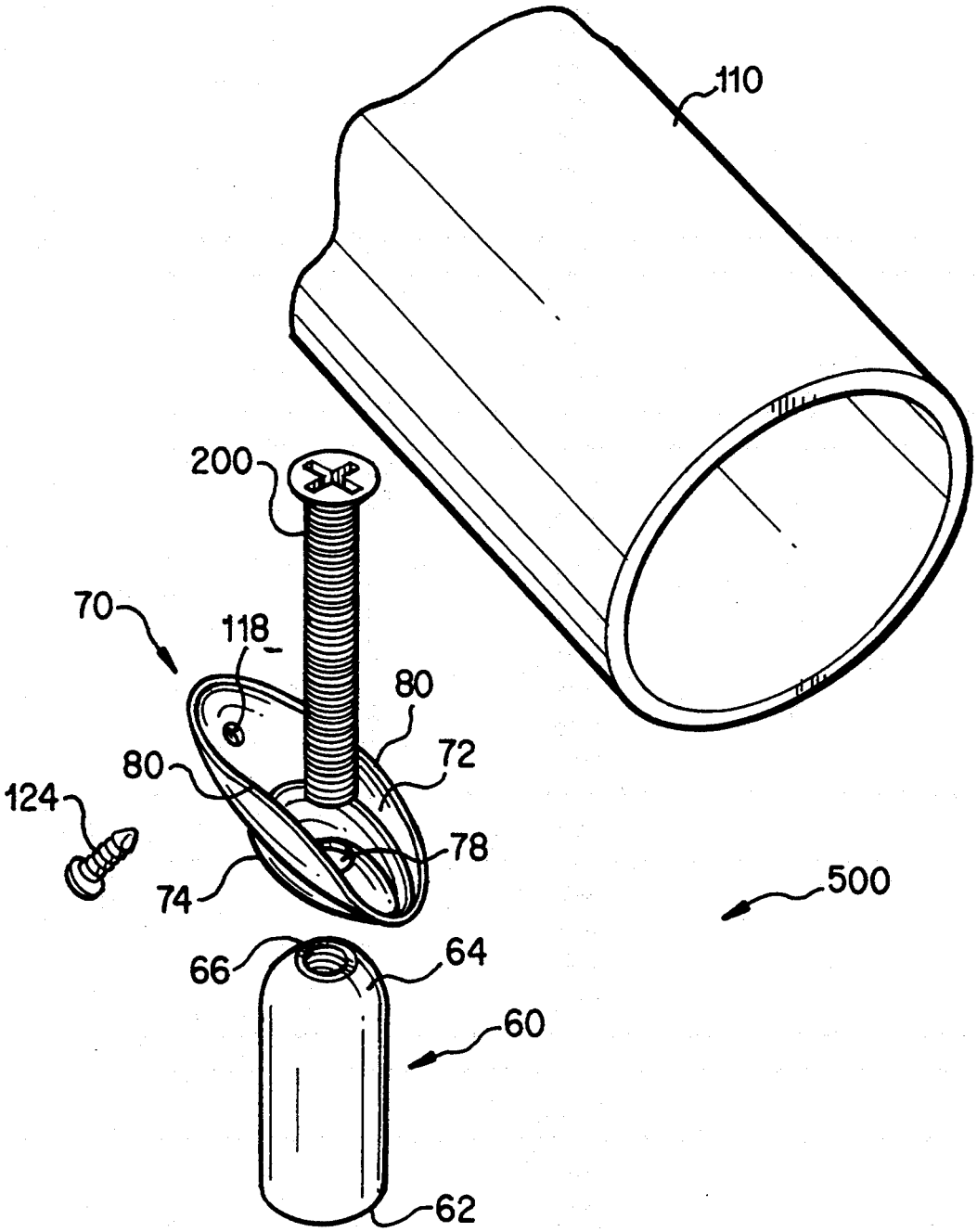
FIG. 6 is an exploded view of an adjustable baluster connector according to a third embodiment of the present invention.
Figure 7A:
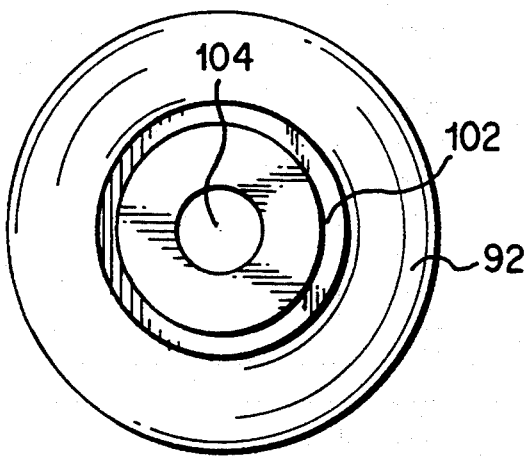
FIG. 7A is a plan view of the top of an adjustable baluster according to the embodiment shown in FIG. 6.
Figure 10:
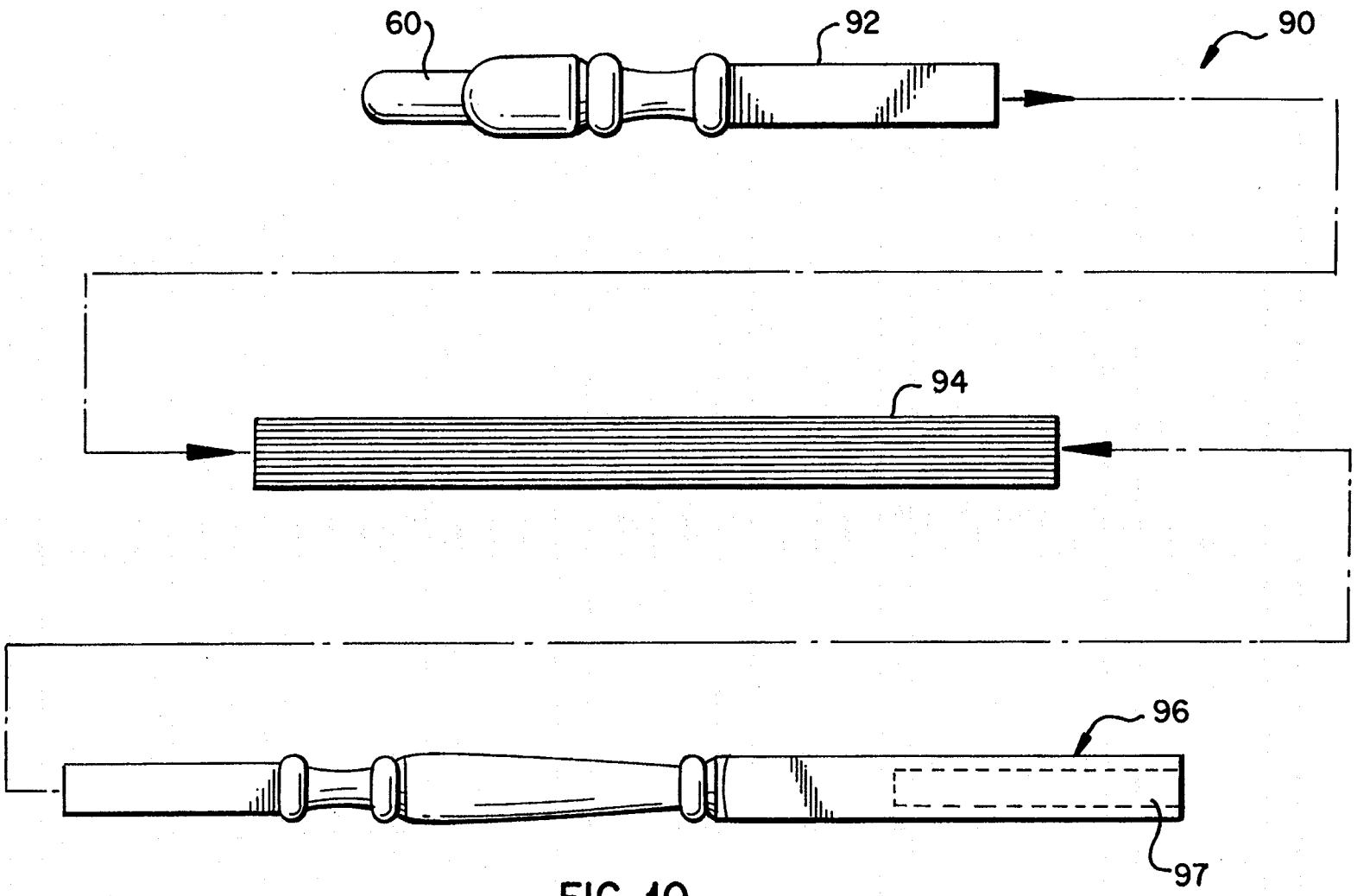
FIG. 10 is an exploded view of an adjustable baluster according to the embodiment shown in FIGS. 6–8, 9A and 9B.

A third embodiment of an adjustable rail support system according to the present invention is shown in FIG. 6. This embodiment includes an adjustable baluster connector indicated generally at 500 and an adjustable baluster indicated at 90. The baluster 90 is shown in FIG. 7B and FIG. 10. As seen in FIG. 7B, the bottom portion 96 includes a blind bore 97 extending from the end thereof. The distance that the bore 97 extends is variable, and should be long enough to allow some of the bottom portion 96 to be cut off to fit the baluster to a particular size rail assembly. By cutting off a desired amount, the baluster can be custom fit to a rail assembly. However, the bore 97 will still be present to allow the baluster to be connected to a tread (not shown).

The right portion of FIG. 7B shows a cut baluster with the dowel 99 that is preferably used to fit in the bore 97 and a matching size bore in the tread. The dowel is preferably fluted and is press fit into the baluster with glue. The thus formed sub assembly of the baluster and the dowel is inserted into the bore in the stair tread.

The baluster connector 500 includes a spindle top 60 in the form of as hollow cylindrical sleeve 60 having an open lower end 62 and a rounded upper end 64. The rounded upper end 64 is closed off except for a centrally disposed aperture 66, defined by an inturned flange 68, which is configured to receive fastening means as described below. The adjustable baluster connector 60 is preferably of one-piece construction and fabricated from a material such as brass.

Figure 8:
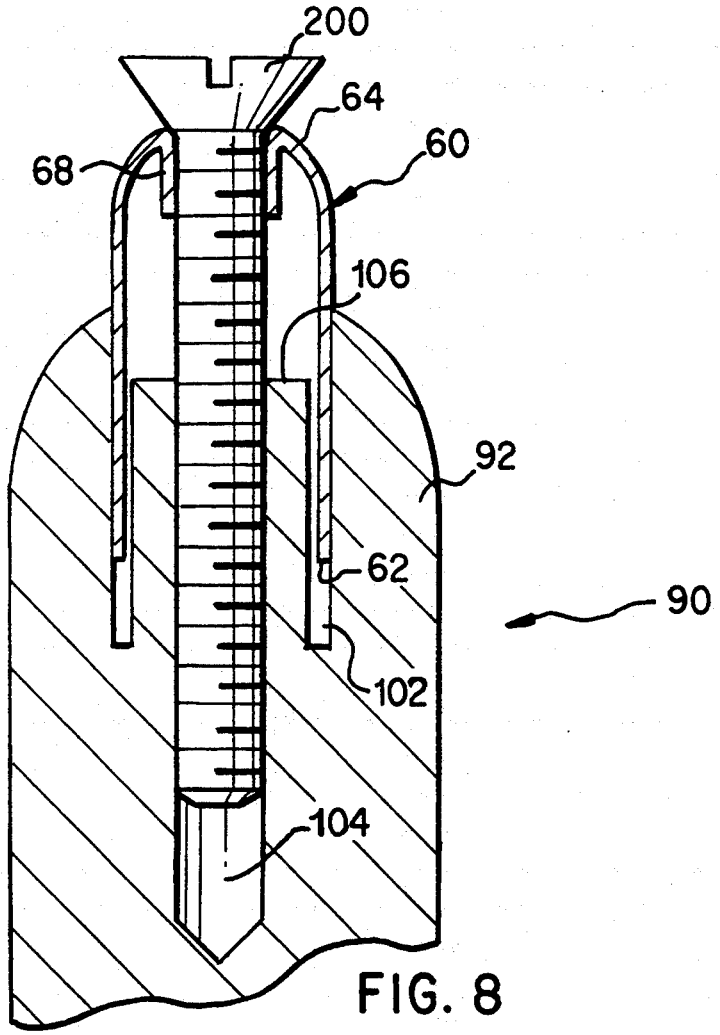
FIG. 8 is a side elevational view of the embodiment of FIG. 6 showing the spindle top member positioned in the baluster.

The adjustable baluster connector 500 cooperates with a baluster 90 as seen in FIG. 8. The baluster 90 is best seen in the exploded view of FIG. 10 and is preferably in the form of an ornamental support member having a top portion 92, a middle portion 94, and a bottom portion 96. The top and bottom portions 92, 96 are preferably made of wood and are sized so as to fit within the interior of middle portion 94, which is a hollow tubular member preferably fabricated from brass or another metallic material. The bottom portion 96 is secured to a stair tread or the like as explained above and as shown in FIG. 7B.

As seen in FIG. 8, the top portion 92 of baluster 90 is rounded at the end 98, which end includes an annular bore 102 and a central bore 104. The annular bore 102 is preferably a blind bore extending partly through the length of top portion 92, and being sized so as to receive the lower open end 62 of spindle top 60 in a sliding fit. The top 92 of post 90 is preferably cut-out at 106 and the annular groove 102 begins at this point. See FIG. 8. This permits spindle top 60 to be placed at its lowermost position within post 90.

FIG. 8 shows spindle top 60 of adjustable baluster support 500 inserted part of the way into annular bore 102. By altering the position of spindle top 60 within the annular bore 102, relatively fine adjustments to the overall height of the baluster 90 can be made. It will be appreciated that the adjustment of the baluster height will primarily be made at the bottom thereof as explained above. Suitable fastening means such as screw 200 cooperates with the central bore 104, which preferably is threaded, to affix the spindle top 60 within the annular groove 102 in the desired position corresponding to the selected height of rail 110.

A small saddle member indicated at 70 (not shown in FIG. 8) is provided to attach the rail 110 to the baluster 90 in this embodiment. The saddle 70 has two surfaces 72, 74, with upper surface 72 being saddle-shaped to receive the exterior surface of a tubular rail 110 in a manner similar to the saddle 10 in the previous embodiments. That is, self-tapping screws 124 pass through apertures 118 into a rail 110. However, the opposite bottom surface 74 of saddle 70 differs from the lower end 12 of saddle 10 in that it is not spherically-shaped. Rather, bottom surface 74 of saddle 70 is formed with an arcuate depression 76 configured to mate with the rounded upper end 98 of the baluster 90.

Figure 9B:
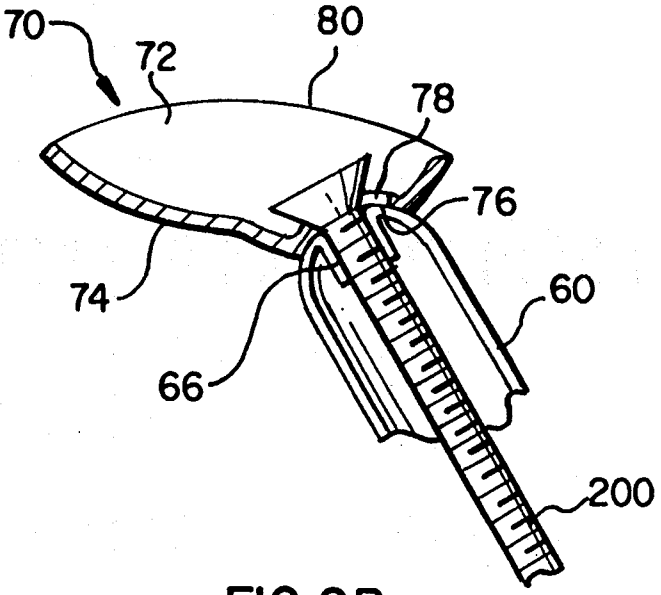
FIGS. 9A and 9B are, respectively, a front elevational view, and a side elevational view in section, of the embodiment shown in FIGS. 6–8.
Figure 9A:
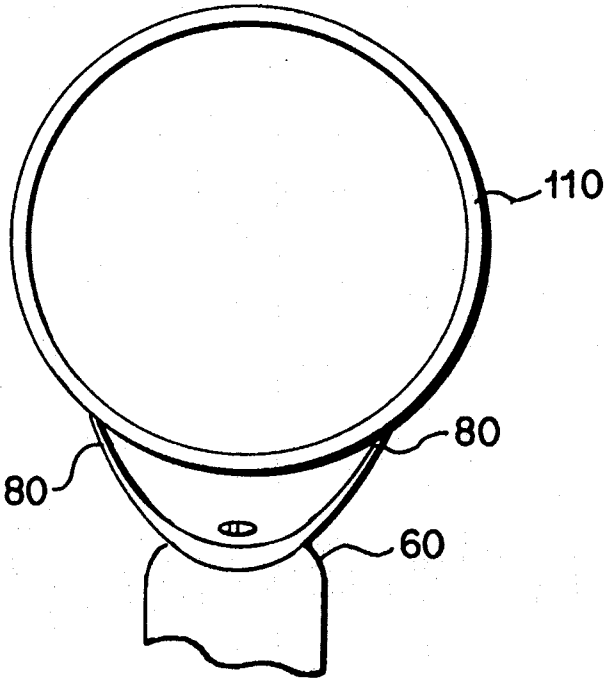

As best seen in FIGS. 9A and 9B, the arcuate depression 76 has a slot 78 which is aligned with aperture 66 of spindle top 60 and central bore 104 of baluster 90 when the saddle 70 is positioned as shown in FIG. 9B. The slot permits relative rotation between the saddle 70 and spindle top 60 to adjust the position of the saddle 70, which receives the rail 110.

The aperture 66 of spindle top 60, and the central bore 104 of the top portion 92 of baluster 90, are preferably threaded to receive the bolt or screw 200. After the desired depth at which the spindle top 60 is to be placed in the annular groove 102 of baluster 90 is determined, the bolt 200 is passed through the slot 78 in saddle 70 and the threaded aperture 66 of spindle top 60. The subassembly of the bolt 200, the saddle 70, and the spindle top 60 are then secured to the baluster 90 with the open lower end 62 of spindle top 60 positioned in annular groove 102.

The bolt 200 is threaded to the desired depth in the threaded central bore 104 of baluster 90, with the cooperating threads serving to secure the subassembly at the desired depth in annular groove 102. The saddle 70 is adjusted to the proper angle with respect to the spindle top 60 by pivoting or rotating the former on the rounded end 64 of the latter. This angular adjustment can be made before the subassembly is attached to the baluster 90, or just before the bolt 200 is threaded into its final position in the spindle top 60 and into the threaded central bore 104 of baluster 90. The self-tapping screws 124 are then used to affix the adjustable baluster connector 500 to the rail 110 as explained above.

Figure 11:
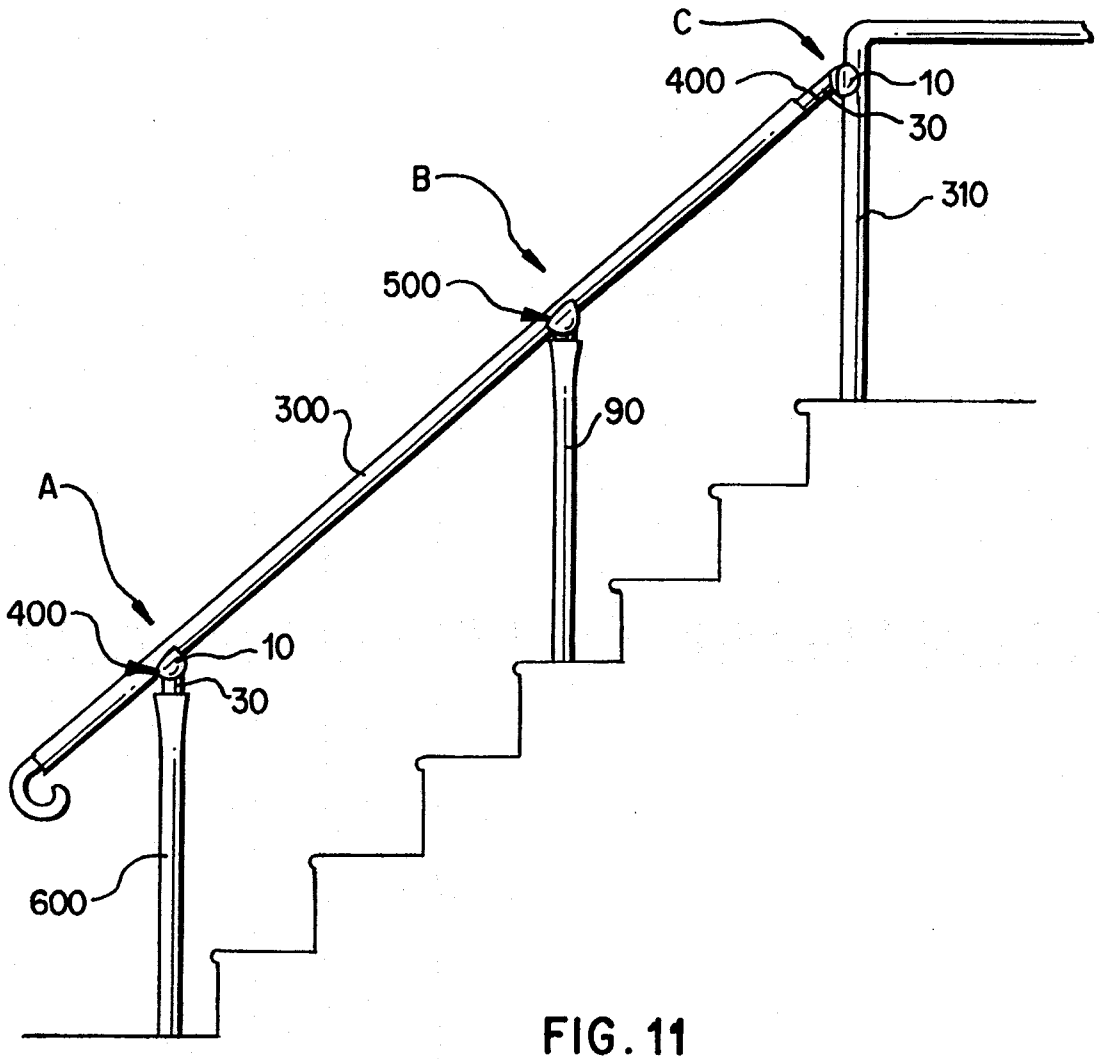
FIG. 11 is a schematic drawing of a preferred stair rail constructed in accordance with the present invention.

FIG. 11 shows a schematic diagram of a preferred embodiment of a stair rail constructed in accordance with the present invention. As an example, the rail 300 can be supported at arrow A by an adjustable tee 400 including a tubular socket 30 and saddle 10 secured to a vertical post 600. At arrow B, the rail can be supported on a baluster 90 by the adjustable baluster connector 500 of the last-described embodiment. At arrow C, where the rail 300 is affixed to a vertical support post 310, the socket 30 of the adjustable tee 400 is positioned in the hollow end of the rail 300, and the saddle 10 is secured to the exterior surface of vertical support 310 as described above. It will, of course, be recognized that the arrangement depicted in FIG. 11 is for exemplary sake only and that there are many possible configurations in which the present invention can be utilized.

It is apparent that the present invention provides an aesthetically pleasing yet easily assembled stair rail system. All of the components are preferably of one-piece construction to simplify both assembly of the system as well as manufacturing of the components.

While the present invention has been described with respect to preferred embodiments thereof, it is to be understood that the invention is not limited to such precise forms of the apparatus, and that changes may be made therein without departing from the scope of the invention defined in the appended claims.

What is claimed is:

1. An adjustable baluster connector system including a plurality of balusters adapted to support an inclined rail, the system comprising:

a plurality of balusters each of which has an upper portion, the upper portion of each baluster having an annular groove formed therein which groove extends from an end of the baluster toward a middle portion of the baluster to form an annular bore, each of said balusters including a bore formed therein adjacent the annular groove;

a plurality of spindle top members each including a hollow cylindrical sleeve having an open lower end and a rounded, dome-shaped upper end, said open lower end of each spindle top being received in the annular groove of one of said plurality of balusters, said rounded upper end of each spindle top having an aperture passing therethrough;

a plurality of saddle members each having opposite surfaces and an opening passing through the saddle member from one of said opposite surfaces to the other of said opposite surfaces, one of said opposite surfaces of each saddle member including an arcuate depression positioned on the rounded upper end of a respective spindle top so that the position of the saddle member can be adjusted with respect to the spindle top, and the other of said opposite surfaces of each saddle member including a saddle shaped recess configured to receive a tubular rail; and a fastener engaging the aperture of a respective spindle top, the opening of a respective saddle member, and the bore of a respective baluster to secure the spindle top and the saddle member to the baluster.

2. An adjustable baluster connector system according to claim 1, wherein the bore is disposed interior to the annular groove and along a central axis of the baluster.

3. An adjustable baluster connector system according to claim 2, wherein said opening in each saddle member is in the form of a slot which permits the saddle member to be adjusted angularly with respect to the spindle top by selectively positioning the rounded upper end of the spindle top within the arcuate depression formed in the saddle member, and then passing said fastener through the slot in the saddle member, the aperture in the spindle top, and into the bore formed in the baluster.

4. An adjustable handrail system according to claim 1, wherein the middle portion of each baluster is a separate ornamental brass member attached to upper and lower portions of each baluster.

5. An adjustable baluster connector system according to claim 1, wherein the balusters each have a lower portion with a blind bore therein for receiving means for securing the baluster to a support surface, and whereby the lower portion of each baluster can be cut to provide a baluster having a selected height.

6. An adjustable tee support apparatus for a stair rail, the apparatus comprising:

a one-piece socket in the form of a hollow tubular member having two ends, one end being open and the other end being closed except for a central aperture, the closed end defining an arcuate recess with said aperture disposed substantially centrally in said recess;

a one-piece hollow ball member adjustably engaging said socket, the ball member having one end with an exterior surface that is substantially spherically-shaped and is positioned within the arcuate recess of the socket with the socket engaging only the exterior surface of the ball member, the ball member being angularly adjustable with respect to the socket in a plurality of directions, said ball member having another end with means for attaching the ball member to a separate member;

wherein the ball member includes an elongated slot, separate from said attaching means, formed along said substantially spherically-shaped end so as to be centrally disposed therein, said slot being aligned with the aperture in the socket so as to permit the ball member to be angularly adjusted with respect to the socket in either of said plurality of directions with the arcuate recess engaging only the exterior surface of the ball member; and means for passing through the slot in the ball member and the aperture in the socket to secure the respective members together in the desired position.

7. An adjustable tee support apparatus for a stair rail according to claim 6, wherein the end of the ball member that has means for attaching the ball member to a separate member is saddle-shaped to receive a tubular rail, and includes apertured extensions extending into the hollow interior of the ball member for receiving fastening means for attaching the ball member to the stair rail.

8. An adjustable tee support apparatus for a stair rail according to claim 6, wherein the end of the ball member that has means for attaching the ball member to a separate member includes a pair of flat extensions which extend outwardly from the hollow interior of the ball member to form a base portion that can be secured to a flat support surface.

9. An adjustable stair rail system including a plurality of balusters and at least one vertical support post, and an inclined rail secured to said balusters and said post, wherein said vertical support post has an exterior surface to which a terminal end of the rail is attached, the system comprising:

a plurality of balusters each of which has an upper portion, the upper portion of each baluster having an annular groove formed therein which groove extends from a point adjacent an end of the baluster toward a middle portion thereof to form an annular bore;

a plurality of adjustable baluster connectors each including a spindle top member including a hollow cylindrical sleeve having an open lower end and a rounded upper end, said open lower end of each spindle top being positioned in the annular groove of a respective baluster, and said rounded upper end of each spindle top having an aperture in which means for securing the spindle top to one of the balusters is disposed;

a plurality of saddle members each having opposite surfaces, one surface including an arcuate depression that is adjustably positioned on the rounded upper end of a respective spindle top so that the position of the saddle member can be pivoted with respect to the spindle top, and the other surface of each saddle member including a saddle shaped recess in which the exterior surface of the rail is positioned, with means for attaching a respective saddle member to the surface of the rail;

said rail being a hollow tube having a terminal end providing access into the hollow interior of the rail;

a socket in the form of a hollow tubular member having two ends, one end being open and the other end being closed except for a central aperture, the closed end defining an arcuate recess with said aperture disposed in said recess, said open end being positioned within the terminal end of the rail;

a ball member adjustably engaging said socket, the ball member having one end that is substantially spherically-shaped and disposed in the arcuate recess of the socket to permit the ball member to be rotatably adjusted with respect to the socket, said ball member having another end which is saddle-shaped and which is affixed to the exterior surface of said vertical support post so as to partly surround the post;

an elongated slot formed in said ball member along said substantially spherically-shaped end, said slot being aligned with the aperture in the socket so as to permit the ball member to be angularly adjusted with respect to the socket recess to a desired position; and means for passing through the aperture in the socket and the elongated slot in the ball member for adjustably securing the two members in a selected relative angular position.

* * * * *